US009604773B2

(12) United States Patent
Verville et al.

(10) Patent No.: US 9,604,773 B2
(45) Date of Patent: Mar. 28, 2017

(54) INSERT WITH NOZZLE FORMED BY MICRO STEPPED AND CONICAL SURFACES

(71) Applicant: SUMMIT PACKAGING SYSTEMS, INC, Manchester, NH (US)

(72) Inventors: Kevin G. Verville, Deerfield, NH (US); Daniel E. Davideit, Manchester, NH (US); Marcel Faucher, New Boston, NH (US); Elizabeth A. Green, Milford, NH (US)

(73) Assignee: Summit Packaging Systems, Inc., Manchester, NH (US)

( * ) Notice: Subject to any disclaimer, the term of this patent is extended or adjusted under 35 U.S.C. 154(b) by 0 days.

(21) Appl. No.: 15/000,251

(22) Filed: Jan. 19, 2016

(65) Prior Publication Data

US 2016/0236853 A1 Aug. 18, 2016

Related U.S. Application Data

(60) Provisional application No. 62/105,430, filed on Jan. 20, 2015.

(51) Int. Cl.
*B65D 83/20* (2006.01)
*B65D 83/28* (2006.01)

(52) U.S. Cl.
CPC ..... *B65D 83/205* (2013.01); *B65D 83/28* (2013.01); *B65D 83/206* (2013.01); *B65D 83/207* (2013.01)

(58) Field of Classification Search
CPC .... B65D 83/28; B65D 83/205; B65D 83/206; B65D 83/207
See application file for complete search history.

(56) References Cited

U.S. PATENT DOCUMENTS 5,711,488 A * 1/1998 Lund ..... B05B 1/3436 239/333
5,992,765 A * 11/1999 Smith ..... B05B 1/3436 239/337
6,443,370 B1 * 9/2002 Brulle ..... B05B 1/3436 222/321.6
6,543,703 B2 * 4/2003 Blake ..... B05B 1/3436 239/106

(Continued)

*Primary Examiner* — Frederick C Nicolas
(74) *Attorney, Agent, or Firm* — Davis & Bujold PLLC; Michael J. Bujold

(57) ABSTRACT

An actuator which comprises an actuator outlet, a post located within the actuator outlet which extends normal to a base surface of the actuator outlet, and the post comprises diametrically opposed first and second alignment protrusions. An insert is mounted and securely retained within the actuator outlet by an interference fit and the base of the insert has a discharge nozzle formed therein. First and second alignment protrusions space the insert away from the post and define a partially restricted flow passages while unobstructed product flow passages are defined one either side of the second alignment protrusions. The first and second stepped shoulders are axially respectively aligned with the first partially restricted flow passage while the first and second conical surface are respectively axially aligned with unobstructed flow passages so that the product to be dispensed, upon being discharged, is sprayed by the nozzle in a fan spray pattern.

20 Claims, 15 Drawing Sheets

(56) References Cited

U.S. PATENT DOCUMENTS

| | | | | |
|---|---|---|---|---|
| 7,854,355 | B2 * | 12/2010 | Rossignol | B05B 11/3004 222/321.7 |
| 7,891,525 | B2 * | 2/2011 | Behar | B05B 11/3059 222/153.11 |
| 8,820,665 | B2 * | 9/2014 | Nelson | B05B 1/042 239/589 |
| 2004/0238573 | A1 * | 12/2004 | Parmentier | B05B 1/3436 222/321.1 |
| 2009/0078793 | A1 * | 3/2009 | Nelson | B05B 1/042 239/433 |
| 2014/0367490 | A1 * | 12/2014 | Neuhalfen | B05B 1/042 239/337 |

* cited by examiner

INSERT WITH NOZZLE FORMED BY MICRO STEPPED AND CONICAL SURFACES

FIELD OF THE INVENTION

The present invention generally relates to a fluid dispensing device for dispensing a product and producing a desired spray pattern.

BACKGROUND OF THE DISCLOSURE

Spray actuators/nozzles are used to dispense fluids from a variety of different containers. The product dispensing containers may hold one or a combination of different ingredients, and typically use a permanent or temporary pressure force to discharge the product contents from the container. If the container is an aerosol can, for example, one or more chemicals or other active ingredients to be dispensed are usually mixed in a solvent and are typically further mixed with a propellant to pressurize the container. Known propellants include, for example, carbon dioxide, various hydrocarbon gases, or mixtures of hydrocarbon gases such as a propane/butane.

The active/propellant mixture may be stored under constant, but not necessarily continuous, pressure in an aerosol can. A dispensing valve is mounted in the top end of the container and is normally located in a closed position. An actuator is coupled to the dispensing valve for actuating the dispensing valve into the open position. The sprayed product to be dispensed may exit in an emulsion state, single phase, multiple phase, and/or partial gas phase and may include insect control agents (such as propellant, insecticide, or growth regulator), fragrances, sanitizers, cleaners, waxes or other surface treatments, and/or deodorizers.

The spray patterns generated by conventional nozzles are not particularly well suited for many household applications. Conventional nozzles typically generate a conical spray jet which, in turn, leads to inconsistent, uneven coverage of a surface. Additionally, when treating a flat surface of a rectangular shape, for example, it is often very difficult to reach and spray the entire surface with a conical-shaped spray jet. More specifically, a conical-shaped spray jet cannot reach corners without also partially reaching adjacent surfaces, leading to overspraying. Other nozzles are known which produce a relatively flat fan-shaped spray jet. While a fan-shaped jet is able to reach corners more reliably without overspraying, the product to be dispensed is not distributed uniformly across the entire spray pattern and the relatively flat pattern requires excessive movement by the user to reach the entire surface to be covered.

SUMMARY OF THE INVENTION

Wherefore, it is an object of the present invention to overcome the above mentioned shortcomings and drawbacks associated with the prior art.

The present invention also relates to an actuator comprising: an actuator outlet being formed within the actuator; a post being centrally located within the actuator outlet of the actuator and extending normal to a base surface of the actuator outlet toward an open end of the actuator outlet; an insert being mounted and securely retained within the actuator outlet by an interference fit, and a base of the insert having a rectangular-shaped discharge nozzle formed therein; first and second alignment protrusions being sized and shaped so as to assist with spacing an inwardly facing cylindrical surface of the insert away from an exterior surface of the post and respectively define a first and second partially restricted flow passages between the inwardly facing cylindrical surface and the exterior surface of the post, with first and second unobstructed product flow passages being defined one either side of the first and the second alignment protrusions; and the nozzle being defined within the base of the insert by diametrically opposed first and second stepped shoulders and diametrically opposed first and second conical surfaces, the first stepped shoulder being axially aligned with the first partially restricted flow passage and the first conical surface being axially aligned with the first unobstructed flow passage while the second stepped shoulder being axially aligned with the second partially restricted flow passage and the second conical surface being axially aligned with the second unobstructed flow passage so that the product to be dispensed, upon flowing through the actuator and being discharged from the nozzle, is sprayed by the nozzle in a desired fan spray pattern.

The present invention also relates to a method of discharging a product to be dispensed from an actuator in a fan spray pattern, the method comprising: forming an actuator outlet within the actuator; centrally locating a post within the actuator outlet of the actuator and so as to extend normal to a base surface of the actuator outlet toward an open end of the actuator outlet; mounting and securely retaining an insert within the actuator outlet by an interference fit, and a base of the insert having a rectangular-shaped discharge nozzle formed therein; sizing and shaping first and second alignment protrusions so as to assist with spacing an inwardly facing cylindrical surface of the insert away from an exterior surface of the post and respectively define a first and second partially restricted flow passages between the inwardly facing cylindrical surface and the exterior surface of the post, with first and second unobstructed product flow passages being defined one either side of the first and the second alignment protrusions; and defining the nozzle within the base of the insert by diametrically opposed first and second stepped insert shoulders and diametrically opposed first and second conical surfaces, the first stepped shoulder being axially aligned with the first partially restricted flow passage and the first conical surface being axially aligned with the first unobstructed flow passage while the second stepped shoulder being axially aligned with the second partially restricted flow passage and the second conical surface being axially aligned with the second unobstructed flow passage so that the product to be dispensed, upon flowing through the actuator and being discharged from the nozzle, is sprayed by the nozzle in a desired fan spray pattern.

BRIEF DESCRIPTION OF THE DRAWINGS

The accompanying drawings, which are incorporated in and constitute a part of the specification, illustrate a few embodiments of the invention and together with the general description of the invention given above and the detailed description of the drawings given below, serve to explain the principles of the invention. The invention will now be described, by way of example, with reference to the accompanying drawings in which.

DETAILED DESCRIPTION OF THE PREFERRED EMBODIMENTS

The present invention will be understood by reference to the following detailed description, which should be read in conjunction with the appended drawings. It is to be appreciated that the following detailed description of various embodiments is by way of example only and is not meant to limit, in any way, the scope of the present invention.

Figure 1:
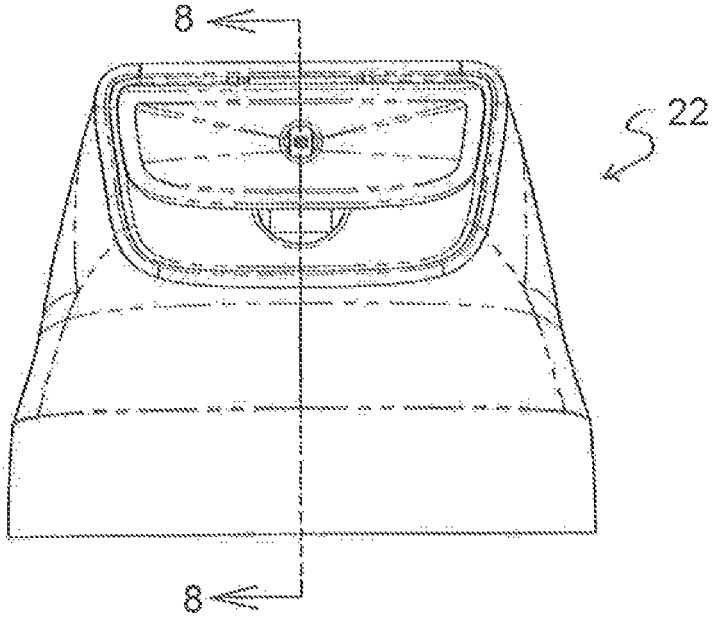
FIG. 1 is a is a diagrammatic view of the improved fan spray insert, according to the present invention, installed on an actuator.
Figure 9:
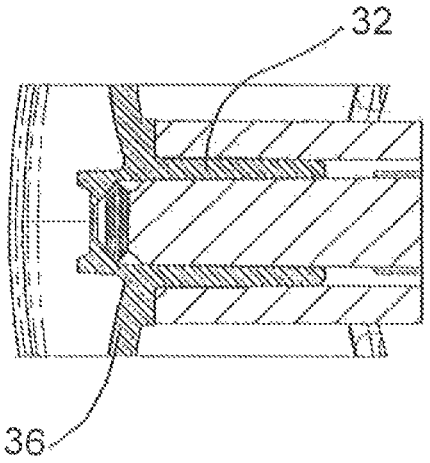
FIG. 9 is a cross-sectional view along section line 9-9 of FIG. 8.
Figure 2:
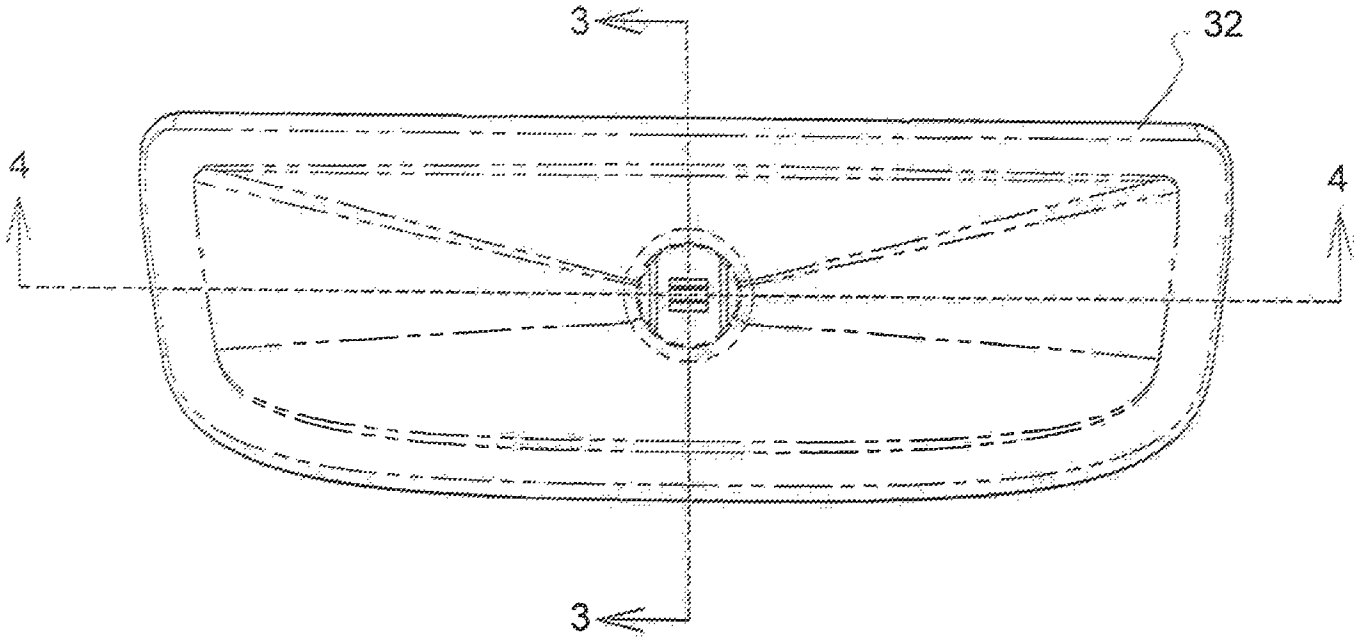
FIG. 2 is a front elevational view of the improved fan spray insert.
Figure 3:
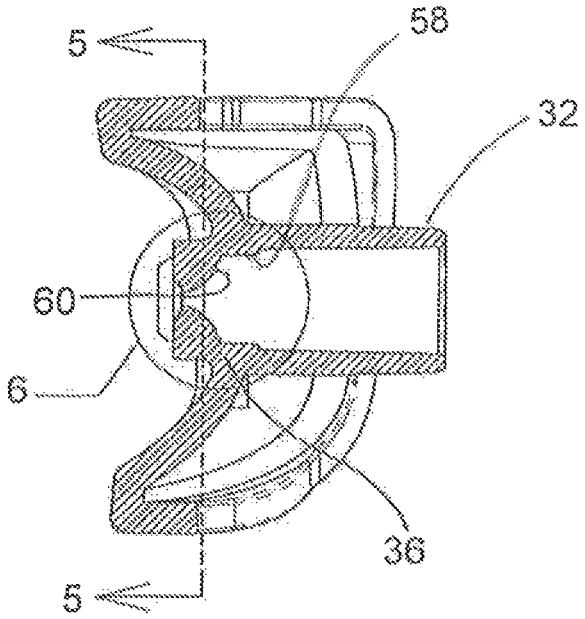
FIG. 3 is a cross-sectional view of the fan spray insert along section line 3-3 of FIG. 2.

An exemplary embodiment of a nozzle 20, for an aerosol container, is illustrated in FIGS. 1 and 2. It will be appreciated, however, that other types of containers and discharging devices, such as trigger pumps, may be used with the improved dispensing nozzle 20 without departing from the spirit and scope of this invention.

As is conventional in the art, the aerosol/pressurized dispenser typically includes a container, such as a conventional metal (e.g., aluminum or steel) container or can, that defines an internal chamber therein which is capable of storing a desired material to be dispensed under pressure. The container includes a base and a cylindrical side wall that is typically closed, along an upper edge thereof, by a dome. The upper portion of the cylindrical wall is joined to the dome by a chime. As is conventional in the art, a mounting cup, supporting a dispensing valve, is secured to a central opening of the dome, by a conventional crimping process, to permanently connect the mounting cup to the dome sealing the container. The dispensing valve has a valve stem that is hollow and projects axially upward out from the dispensing valve and a free end of the valve stem is designed to support the actuator 22. If desired, a dip tube may be connected to an inlet of the dispensing valve to facilitate supplying the product to be dispensed to the dispensing valve.

Turning now to FIGS. 1-11, a brief description concerning the various components of the present invention will be discussed. The actuator 22 is mounted on the upper end of the valve stem to facilitate dispensing of the product contents. As is conventional in the art, upon depressing the actuator/valve stem downwardly or side ways, the dispensing valve is opened/activated. Upon such opening/activation of the dispensing valve, the pressurized product to be dispensed, contained within the metal can or container, is delivered from the internal chamber through the dispensing valve and the valve stem and into the actuator 22 for dispensing.

Figure 8:
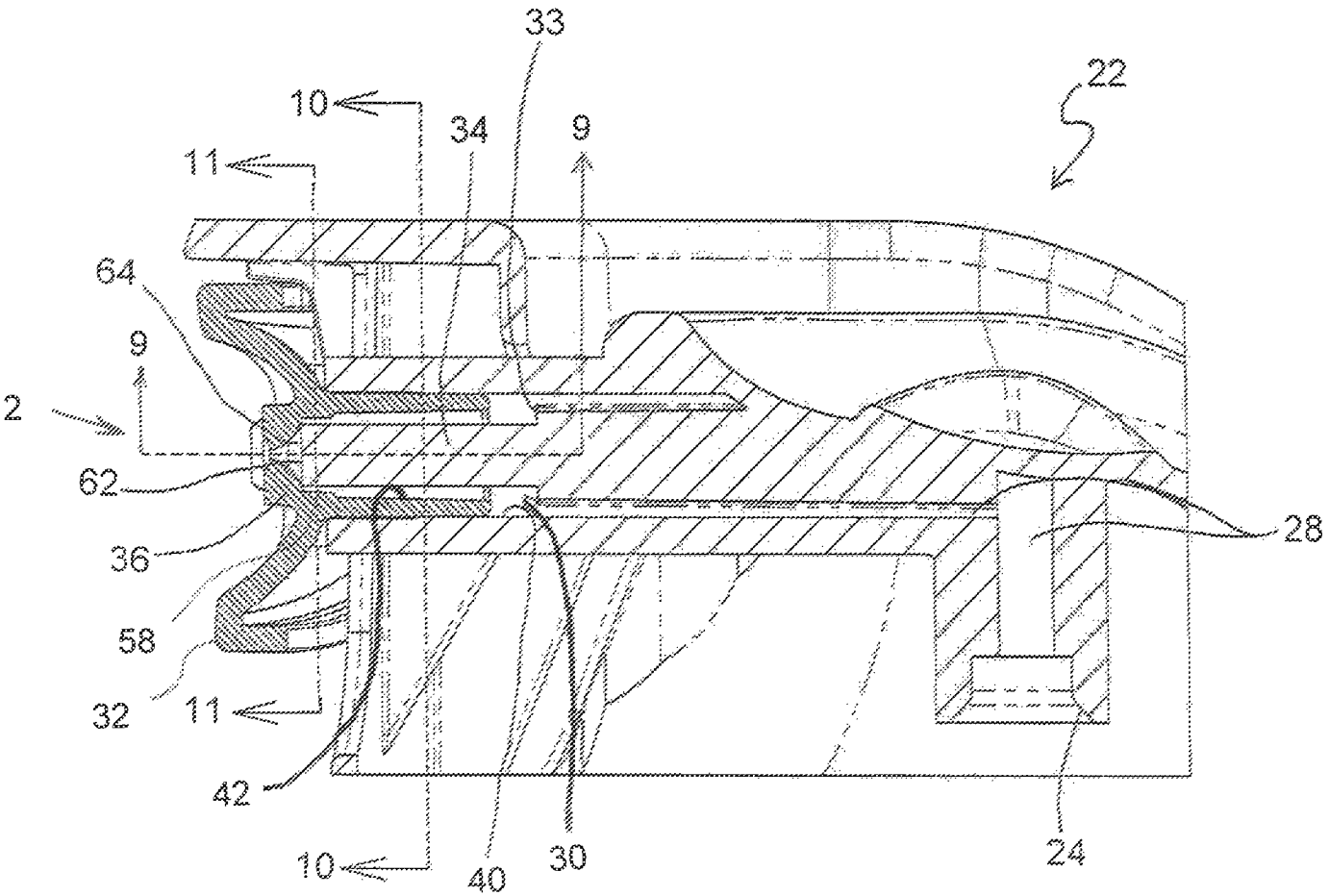
FIG. 8 is a cross-sectional view along section line 8-8 of FIG. 1.
Figure 12:
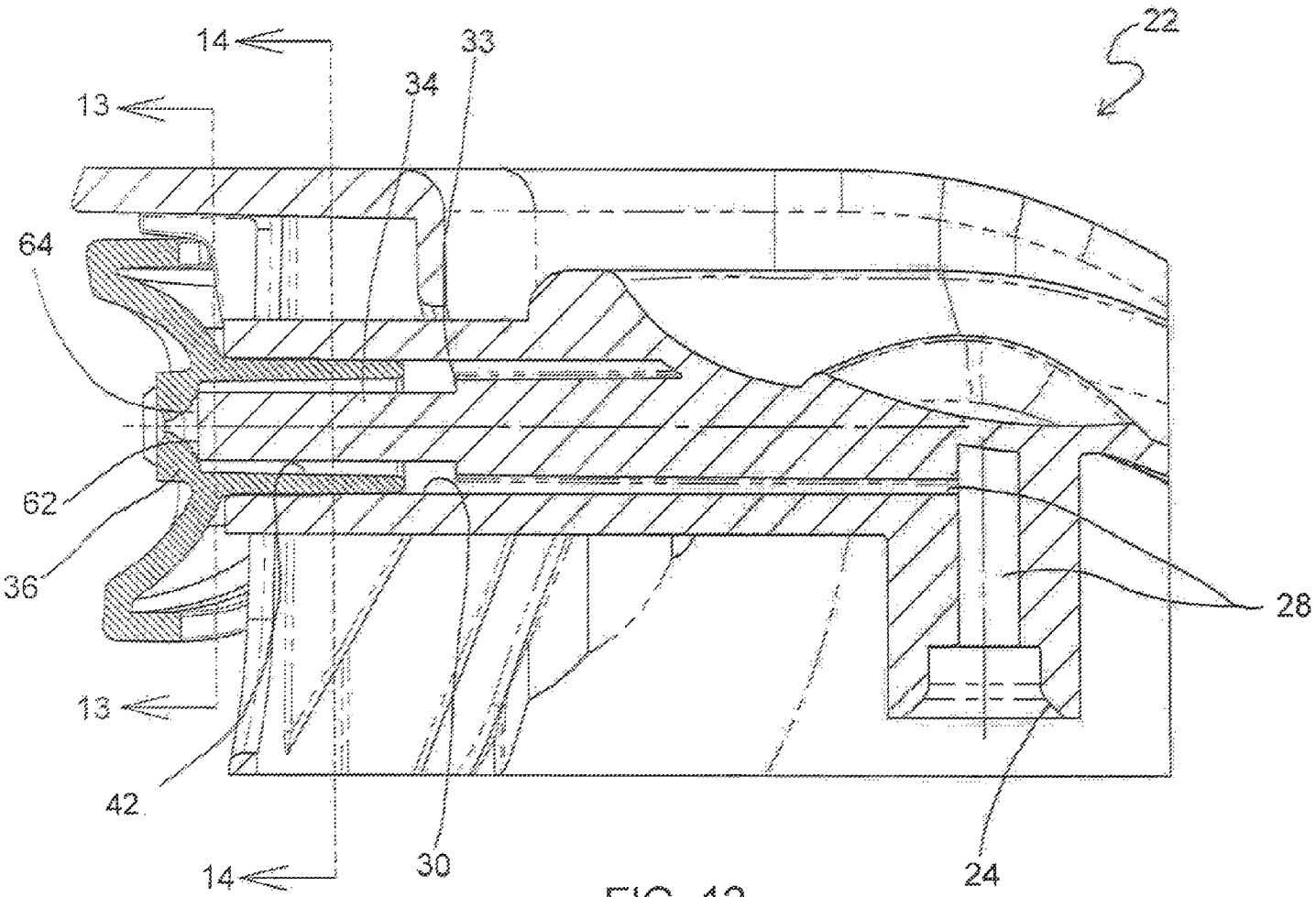
FIG. 12 is a cross-sectional view, similar to the view along section line 9-9 of FIG. 8, showing a second embodiment of the improved fan spray insert without any alignment members.

As shown in FIGS. 8 and 12, the actuator 22 has a centrally located socket/inlet 24, in a base portion thereof, which receives and sealingly engages with the free end of the valve stem in a fluid-tight manner. The socket/inlet 24 of the actuator 22 communicates with a vertical passage 28 that extends from the socket/inlet 24 to an actuator outlet 30, typically formed in a side wall of the actuator 22. The actuator outlet 30 comprises a generally cylindrical opening with a substantially flat base surface 33. A post 34 extends normal to the base surface 33 and is centered within the cylindrical opening of the actuator outlet 30.

The insert 32 is mounted in and securely retained within the actuator outlet 30 by an interference fit. The insert 32 comprises an elongated, generally tubular body which is close by a base 36 of the insert 32. The dispensing nozzle 2 is centrally formed in the base 36 of the insert 32. The outlet of the nozzle 2 has a length of about 0.055 inches and a width of about 0.015 inches. The insert 32 is typically manufactured by conventional injection molding process and manufactured from a resilient plastic, such as acetal, polypropylene or polyethylene.

When the dispensing valve is activated, the product to be dispensed is released by the valve and travels through the actuator 22, via the passage 28, into the actuator outlet 30 for ultimate discharge into atmosphere after exiting through the nozzle 2, as described below in further detail, formed in the base 36 of the insert 32.

Figure 13:
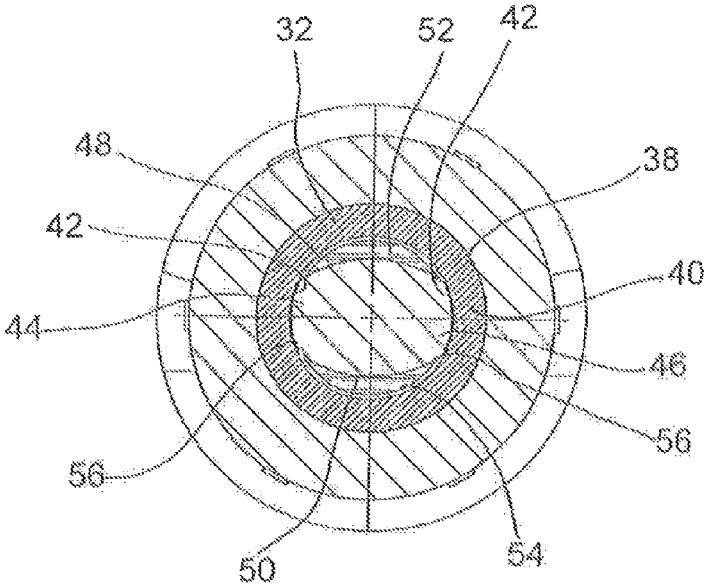
FIG. 13 is a cross-sectional view along section line 13-13 of FIG. 12.
Figure 14:
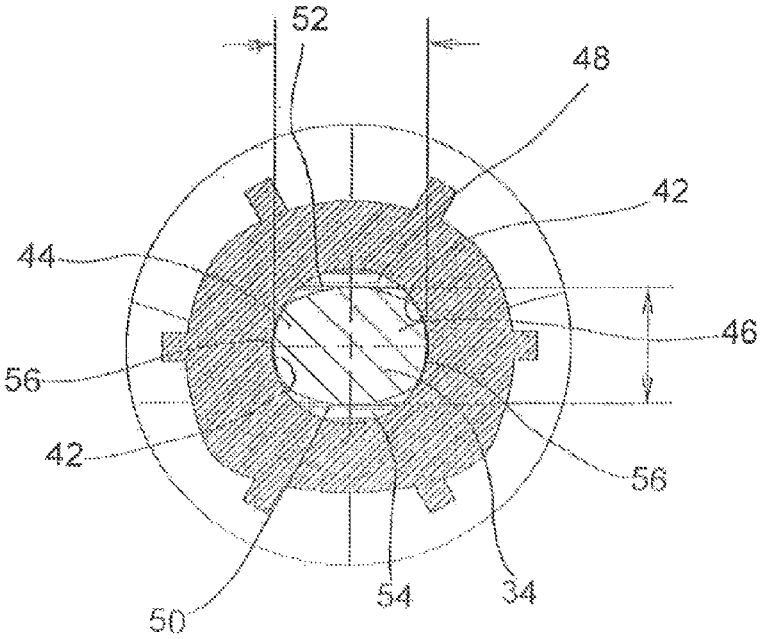
FIG. 14 is a cross-sectional view along section line 14-14 of FIG. 12.
Figure 15:
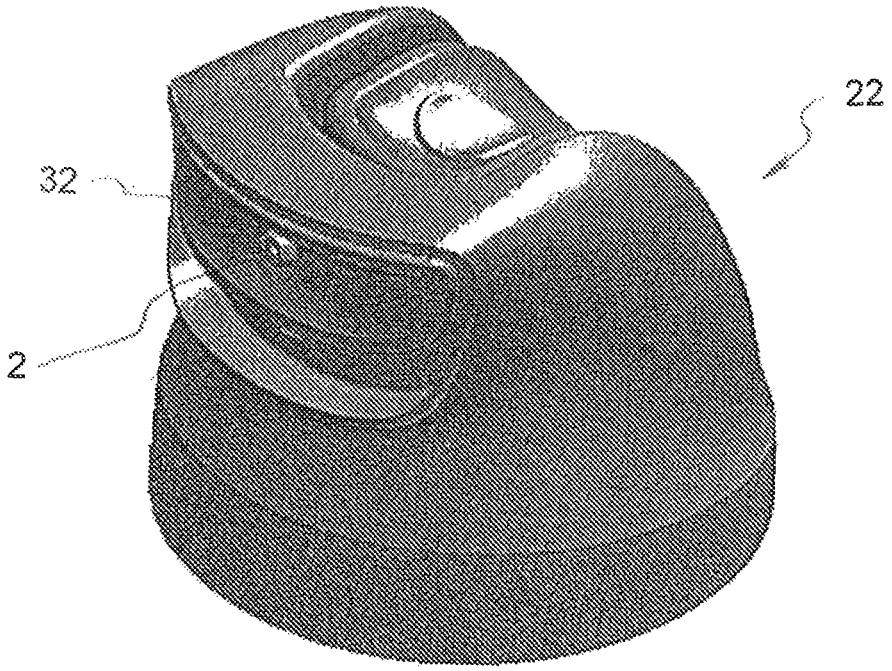
FIG. 15 is a diagrammatic perspective view of a further embodiment of the improved fan spray insert, according to the present invention.

As is conventional in the art, the outwardly facing cylindrical surface 38 of the insert 32 is sized and shaped so as to frictionally engage with an inwardly facing surface 40 of the actuator outlet 30 while the inwardly facing surface 42 of the insert 32 is cylindrical and designed to surround and engage with selected regions of the post 34 of the actuator 22. That is, as can be seen in FIGS. 13 and 14, the post 34 has first and second diametrically opposed post shoulders 44, 46 which are sized and shaped to engage with the inwardly facing surface 42 of the insert 32 and space a portion of the inwardly facing surface 42 of the insert 32, located between the first and the second post shoulders 44, 46, away from a partially recessed outwardly facing surfaces 48, 50 of the post 34. As a result of the first and the second post shoulders 44, 46 spacing of a portion of the inwardly facing surface 42 of the insert 32 away from the partially recessed outwardly facing surfaces 48, 50 of the post 34, a pair of first and second separate and distinct product flow passages/paths 52, 54 are defined on either side of the first and the second diametrically opposed post shoulders 44, 46, between the inwardly facing surface 42 of the insert 32 and the partially recessed outwardly facing surfaces 48, 50 of the post 34.

Figure 11:
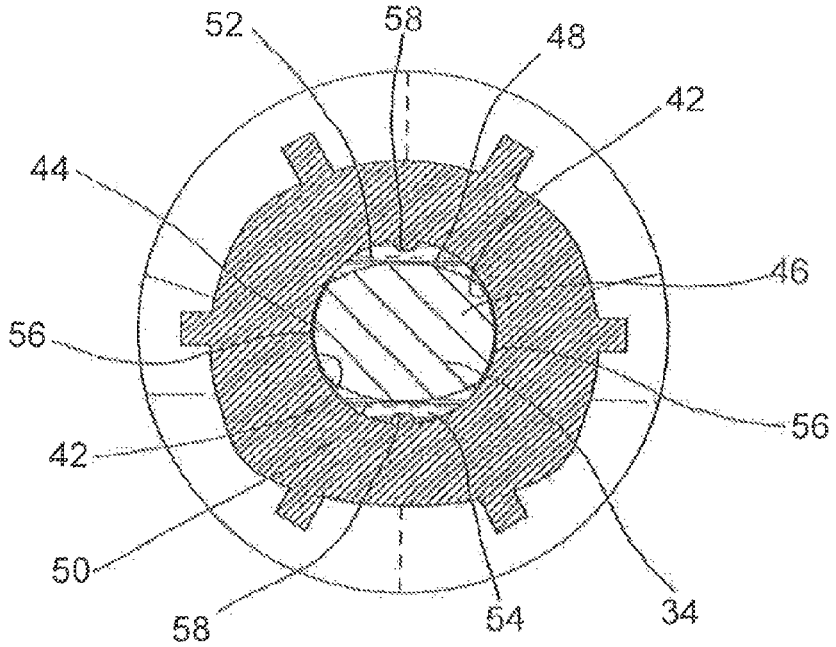
FIG. 11 is a cross-sectional view along section line 11-11 of FIG. 8.
Figure 10:
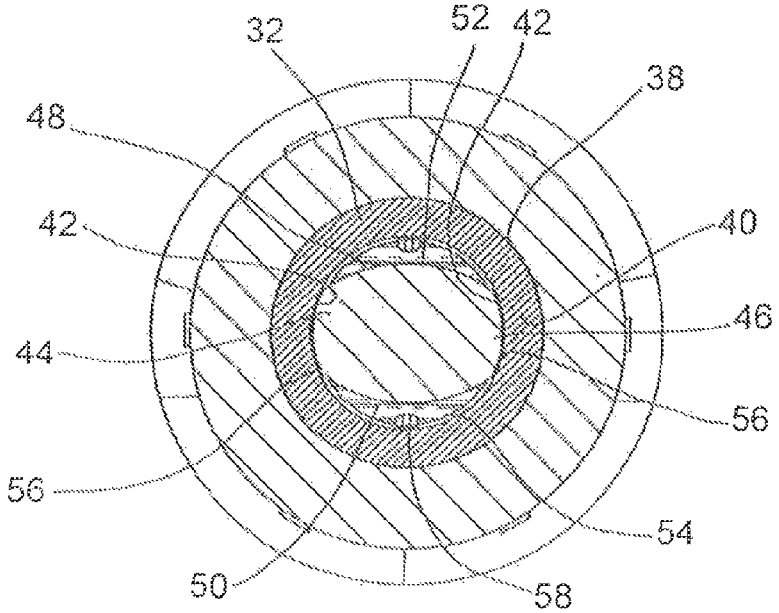
FIG. 10 is a cross-sectional view along section line 10-10 of Fig, 8.

The outwardly facing cylindrical surface 56, of each of the first and the second diametrically opposed post shoulders 44, 46, is cylindrically shaped so as to matingly engage and seal with a corresponding inwardly facing surface 42 of the insert 32 and prevent the flow of any product to be dispensed between those mating surfaces 42 and 56. Due to such sealing engagement, all of the product to be dispensed through the insert 32 is thus redirected and channeled along either one of the first or the second product flow passages/paths 52, 54 defined primarily within the partially recessed outwardly facing surfaces 48, 50 of the post 34. As shown in FIGS. 10 and 11, for example, a first transverse dimension of the post 34, from the outwardly facing cylindrical surface 56 of the first post shoulder 44 to the outwardly facing cylindrical surface 56 of the second post shoulder 46 is about inches 0.118 inches (3 mm) while a second transverse dimension of the post 34, normal to the first transverse dimension, from one section of the partially recessed outwardly facing surfaces 48 or 50 of the post 34 to a diametrically opposed partially recessed outwardly facing surface 50 or 48 of the post 34 is about 0.094 inches (2.4 mm).

It is to be appreciated that the first and second separate and distinct product flow passages/paths 52, 54 are only completed and defined when the insert 32 is coupled to or engaged with the actuator 22 so that the insert 32 closes and seals the outer perimeter surface of the first and the second product flow passages/paths 52, 54. As a result, the product to be dispensed from the container flows substantially along and essentially through passages formed within the post 34 and is merely confined by the cylindrical inwardly facing surface 42 of the insert 32.

Figure 5:
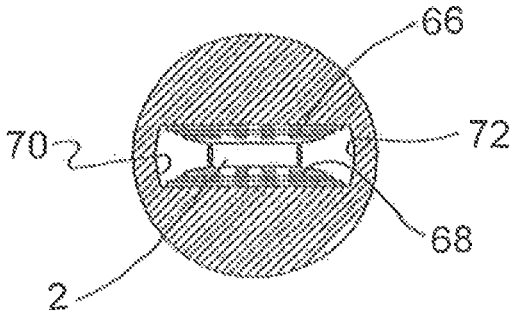
FIG. 5 is a cross-sectional view of the fan spray insert along section line 5-5 of FIG. 3.
Figure 4:
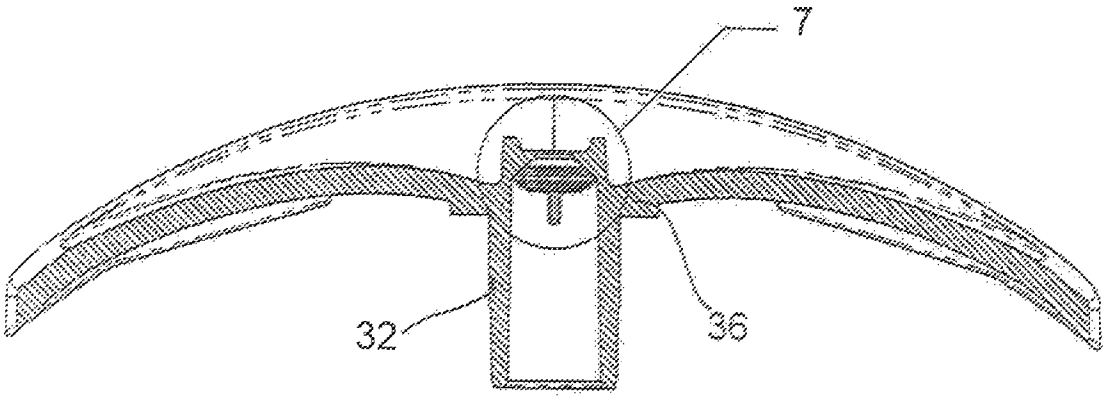
FIG. 4 is a cross-sectional view of the fan spray insert along section line 4-4 of FIG. 2.
Figure 7:
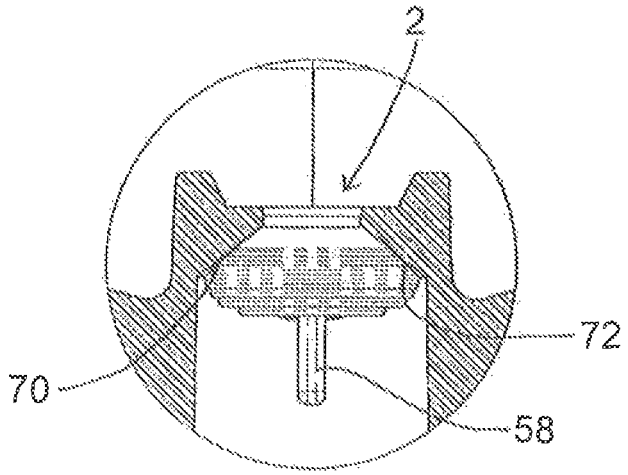
FIG. 7 is an enlarged sectional view of area 7 in FIG. 4 showing the diametrically opposed conical surfaces.

If desired, either a leading or a trailing end of the inwardly facing surface 42 of the insert 32 may support a pair of diametrically opposed alignment members 58 which assist with properly aligning the insert 32 with the post 34, during assembly of the insert 32 with the actuator 22, in order to achieve the desired flow through the nozzle 2 of the insert 32, as will be described in further detail below. FIGS. 3, 6, 8, 10 and 11 show a trailing end of the inwardly facing surface 42 of the insert 32 being provided with a pair of diametrically opposed alignment members. However, depending upon the product to be dispensed, in the event that such diametrically opposed alignment members 58 significantly alters or effects the flow of the product to be dispensed along either the first and/or the second product flow passages/paths 52, 54, one or both alignment members may be eliminated, as shown in FIGS. 12-14, As noted above, the nozzle 2 is formed in base 36 of the insert 32 (see FIGS. 3, 5-8) and designed to dispense the product to be dispensed at a larger discharge angle, thereby to generate a spray having a non-conical shape. An inwardly facing surface 60 of the base of the insert 32 is spaced from an outwardly facing end surface 62 of the post 34 so as to define a flow redirecting dispensing area or chamber 64 therebetween. As shown in FIGS. 2 and 5, the nozzle 2, formed in the base 36 of the insert 32, is generally rectangular in shape. First and second diametrically opposed stepped insert shoulders 66, 68 are formed within the base 36 of the insert and arranged to receive the product to be dispensed, supplied by a respective one of the first and second product flow passages/paths 52, 54, and redirect such product to be dispensed toward the nozzle 2.

A first conical surface 70 is integrally formed and joined with a first end of each of the first and second diametrically opposed stepped insert shoulders 66, 68 while an opposed second conical surface 72 is integrally formed and joined with an opposite second end of each of the first and second diametrically opposed stepped insert shoulders 66, 68. The first and the second conical surfaces 70, 72 each have a radius of curvature of between 0.050 inches and 0.100 inches, more preferably a radius of curvature of about 0.075 inches. The first and second diametrically opposed stepped insert shoulders 66, 68 and the first and second diametrically opposed conical surfaces 70, 72 are designed to channel the product to be dispensed toward and out through the nozzle 2 achieve a desired substantially rectangular fan spray pattern. In order to facilitate the desired spray pattern, the first stepped insert shoulder 66 is directly axially aligned with the first product flow passage/path 52, which is primarily formed in the post 34, while the second diametrically opposed stepped insert shoulder 68 is directly axially aligned with the second product flow passage/path 54, which is primarily formed in the post 34, and the first conical surface 70 is directly axially aligned with the first diametrically opposed post shoulder 44, which minimizes the flow of the product to be dispensed toward the first conical surface 70, while the diametrically opposed second conical surface 72 is directly axially aligned with the second diametrically opposed post shoulder 46, which minimizes the flow of the product to be dispensed toward the second conical surface 72. As a result of such arrangement, the product to be dispensed, which flows along either the first or the second product flow passages/paths 52, 54, is respectively channeled and directed toward the respective one of the first and the second diametrically opposed stepped insert shoulders 66, 68 while only a very small or minor amount of the product to be dispensed, once such product enters into the flow redirecting dispensing chamber 64, is directed toward and flows over either the first and/or the second diametrically opposed conical surfaces 70, 72.

As the product to be dispensed flows over the first and second diametrically opposed stepped insert shoulders 66, 68 toward the nozzle 2, turbulence is induced and created within the product to be dispensed. Such turbulence is believed to assist with improving the formation and shape of the spray pattern of the product to be dispensed, once the same is discharged from the nozzle 2. The minor amount of the product to be dispensed, which is directed toward and flows along either the first and/or the second diametrically opposed conical surfaces 70, 72, generally assist with controlling width of the spray pattern of the product being dispensed, as the product to be dispensed is discharged from the nozzle 2.

Figure 6:
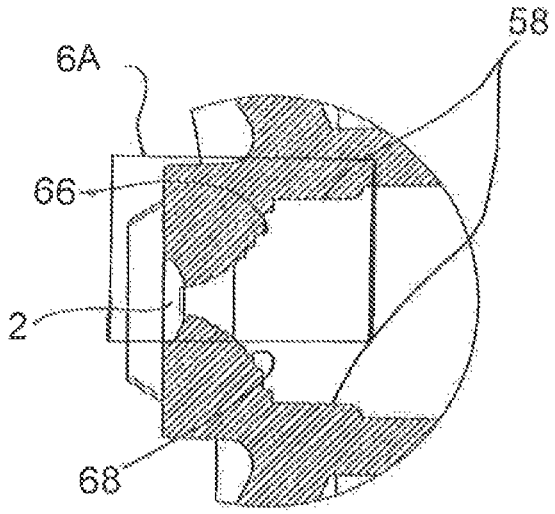
FIG. 6 is an enlarged sectional view of area 6 in FIG. 3 showing the diametrically opposed micro stepped shoulders.
Figure 6A:
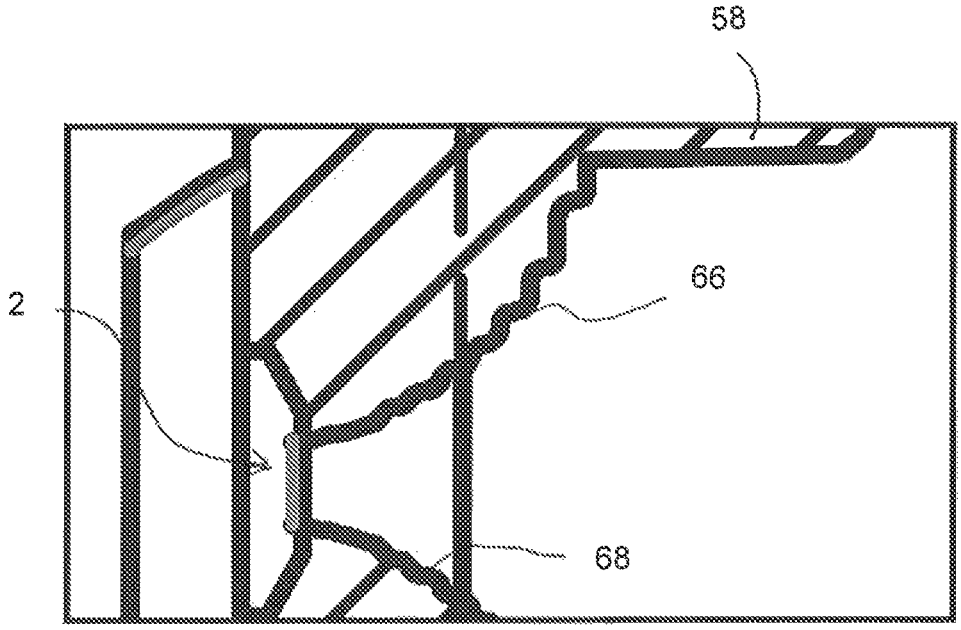
FIG. 6A is an enlarge sectional view of area 6A of FIG. 6.

As generally shown, each of the first and the second diametrically opposed stepped insert shoulders 66, 68 has a total of seven micro steps and each one of the micro steps becomes progressively becomes narrower, e.g., shorter in both length and height, in the direction toward the nozzle 2. The micro steps are generally formed by a series of curved surfaces interconnecting a series of generally flat surfaces with one another which eventually transitions into a relative smooth surface at an outlet of the nozzle 2. It is to be appreciated that the number, size and spacing of the micro steps can vary, from application to application, without departing from the spirit and scope of the present invention. As shown in FIG. 6A, a largest micro step, of the plurality of micro steps, has a length of about 0.012 inches and this largest micro step is spaced from an adjacent second largest micro step by a distance of about 0.005 inches and each remaining micro step has a shorter length and is spaced closer to adjacent micro steps by a smaller distance than the spacing of the largest micro step to the next largest micro step.

During dispensing of the product to be dispensed, the first and second diametrically opposed stepped insert shoulders 66, 68 and the diametrically opposed first and second conical surfaces 70, 72 combine with one another, as the product to be dispensed flows over those insert shoulders and conical surfaces, to generate a spray jet having a generally well-defined substantially rectangular discharge spray pattern. That is, the nozzle 2 has an elongate, rectangular shape which has a width that is greater than its length, i.e., the insert 32 produces a spray pattern that is generally rectangular in shape and has a dimension in a first length direction which is greater than its dimension in an opposite, second width direction.

During dispensing, the actuator 22 is activated to open the dispensing valve thereby releasing the product to be dispensed from the pressurized container, through the actuator 22 and into the external environment. During discharge, the product to be dispensed travels through the passage 28 and into the actuator outlet 30. The product to be dispensed then flows along either the first or the second product flow passages/paths 52, 54, along and substantially within the post 34 while the inwardly facing surface 42 of the insert 32 merely confines the product flow. The product to be dispensed continues flowing along either the first or the second product flow passages/paths 52 or 54 and eventually flows into the flow redirecting dispensing chamber 64. Upon entering the flow redirecting dispensing chamber 64, the product to be dispensed is then redistributed but primarily flows over either the first or the second diametrically opposed stepped insert shoulders 66, 68, while only a minor amount/quantity of product flows over either the first or the second diametrically opposed conical surfaces 70 or 72. Such redistribution of the product to be dispensed causes the product to be dispensed to be discharged through the nozzle 2 in a desired spray discharge pattern, e.g., a generally rectangular shape.

FIG. 12 is a diagrammatic cross-sectional view, similar to the view along section line 9-9 of FIG. 8, showing a second embodiment of the improved fan spray insert which does not include any alignment tabs or members, while FIGS. 13 and 14 are cross-sectional views along section lines 13-13 and 14-14, respectively, of FIG. 12. That is, alignment members which assist with aligning the insert 32 with the post 34, during assembly of the insert 32 with the actuator 22, are eliminated in this embodiment. Since there are not any alignment members, the first and/or the second product flow passages/paths 52, 54 do not include any component which could hinder, obstruct, after or effect the flow of the product to be dispensed along either one of these passages/paths.

Turning now to FIGS. 15-20, a brief description concerning a still further embodiment of the present invention will now be discussed. As this embodiment is very similar to both of the previously discussed embodiments, generally only the differences between this embodiment and the previous embodiments will be discussed in detail while identical elements will be given identical reference numerals.

As with the previous embodiments, the actuator 22 is mounted on the upper end of the valve stem to facilitate dispensing of the product contents. Upon such opening/activation of the dispensing valve, the pressurized product to be dispensed, contained within the container, is delivered from the internal chamber through the dispensing valve and the valve stem and into the actuator 22 for dispensing.

Figure 17:
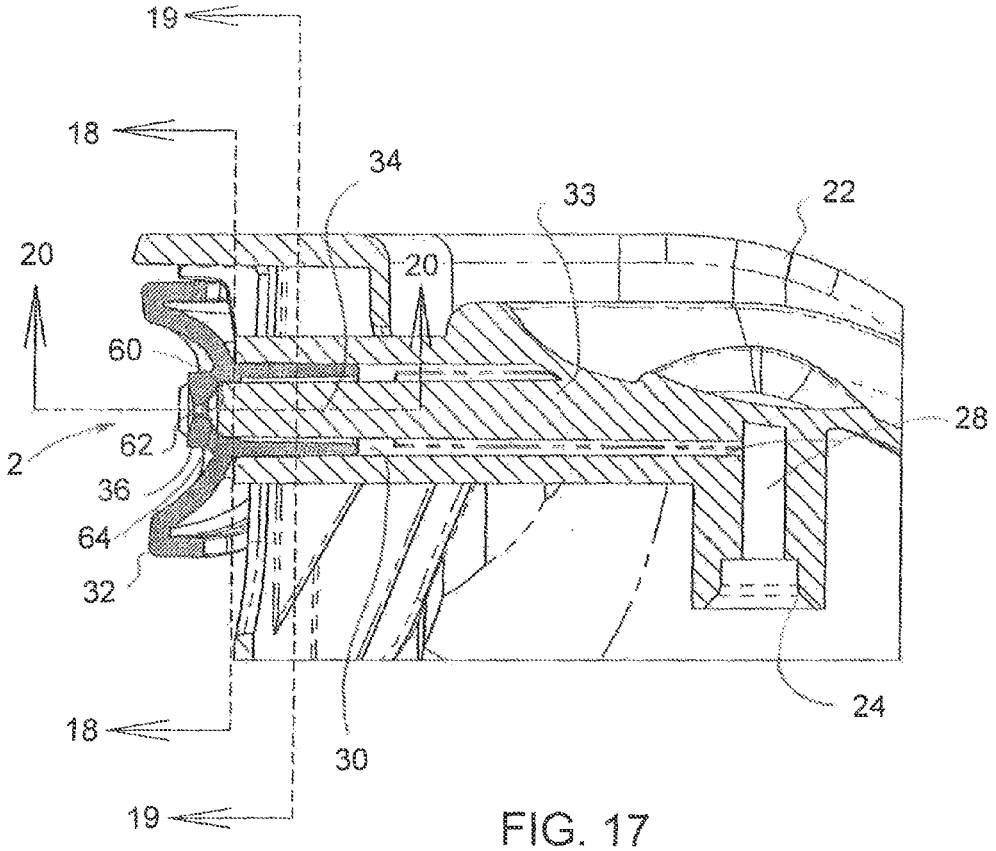
FIG. 17 is a cross-sectional view along section line 17-17 of FIG. 16.

As shown in FIG. 17, the actuator 22 has a centrally located socket/inlet 24, in a base portion thereof, which receives and sealing engages with the free end of the valve stem in a fluid-tight manner. The socket/inlet 24 of the actuator 22 communicates with a passage that extends from the socket/inlet 24 to an actuator outlet 30, typically formed in a side wall of the actuator 22. The actuator outlet 30 comprises a generally cylindrical opening with a substantially flat base surface 33. A post 34 extends normal to the base surface 33 and is centered within the cylindrical opening of the actuator outlet 30.

The insert 32 is mounted in and securely retained within the actuator outlet 30 by an interference fit. The insert 32 generally comprises an elongated, generally tubular body which is dose by a base 36 of the insert. The dispensing nozzle 2 is centrally formed in the base 36 of the insert 32. The insert 32 is typically manufactured by conventional injection molding process and manufactured from a resilient plastic, such as acetal, polypropylene or polyethylene.

When the dispensing valve is activated, the product to be dispensed is released by the valve and travels through the actuator 22, via a passage 28, into the actuator outlet 30 for ultimate discharge into atmosphere after exiting through the nozzle 2 formed in the base 36 of the insert 32, as described below in further detail.

Figure 20:
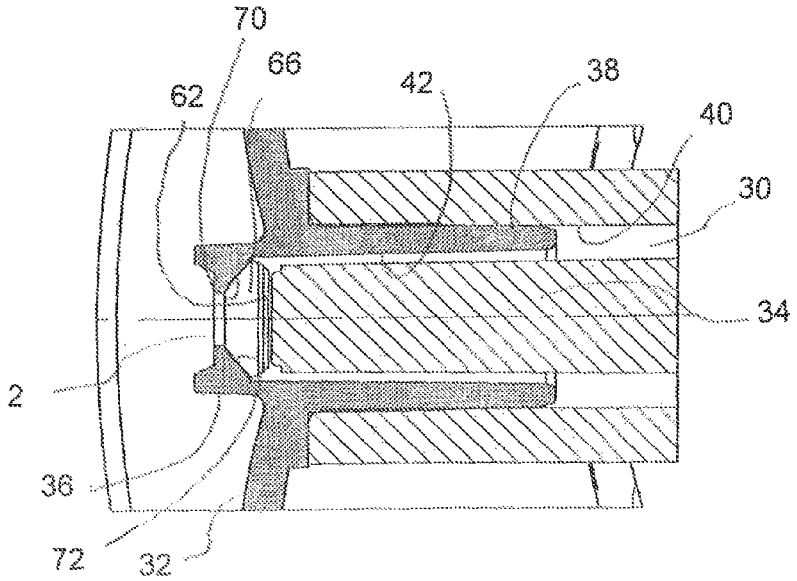
FIG. 20 is a cross-sectional view along section line 20-20 of FIG. 15.

As is conventional in the art and shown in FIG. 20 for example, the outwardly facing cylindrical surface 38 of the insert 32 is sized and shaped so as to frictionally engage an inwardly facing surface 40 of the actuator outlet 30 while the inwardly facing surface 42 of the insert 32 is cylindrical and designed to surround and be spaced from exterior surface of the post 34 of the actuator 22. That is, as can be seen in FIGS. 17-20, the post 34 is cylindrical and is designed, according to this embodiment, to be spaced away from the inwardly facing surface 42 of the insert 32 so as to generally avoid engagement therewith and define a flow passage therebetween.

Figure 18:
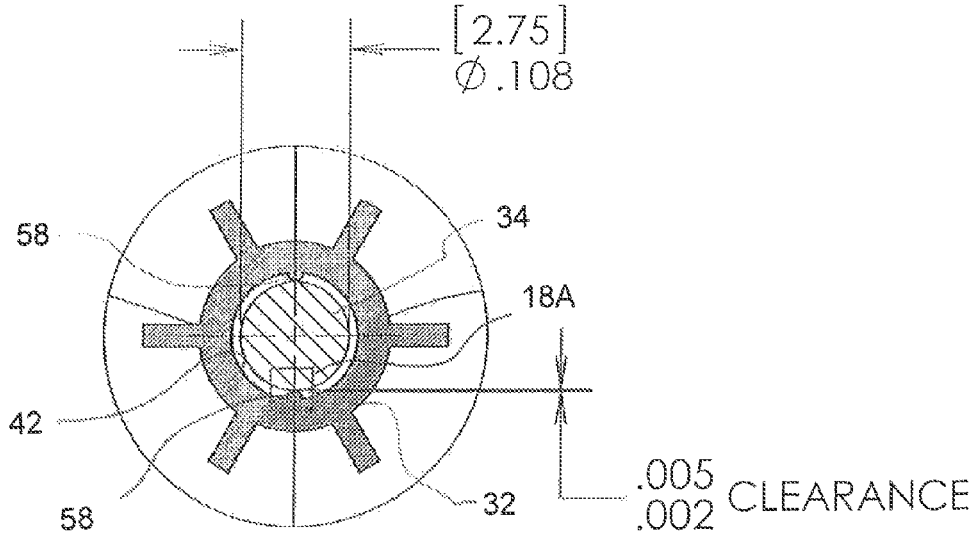
FIG. 18 is a cross-sectional view along section line 18-18 of FIG. 17.
Figure 19:
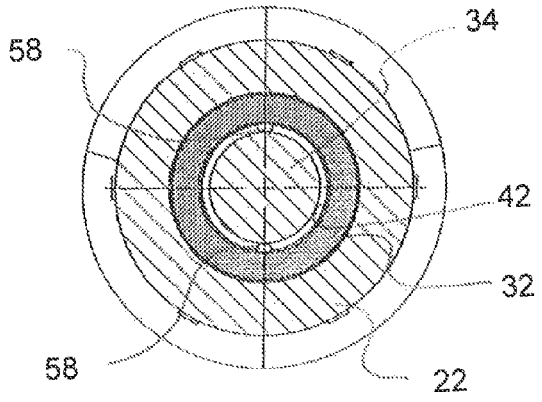
FIG. 19 is a cross-sectional view along section line 19-19 of FIG. 17.
Figure 18A:
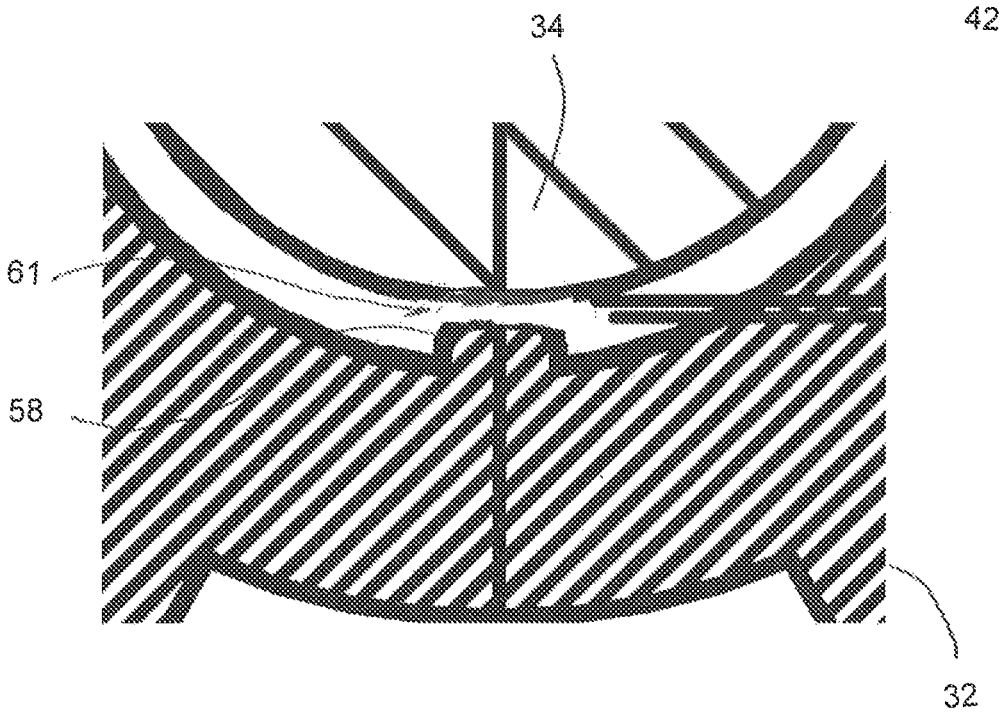
FIG. 18A is an enlarge view of area 18A of FIG. 18.

The inwardly facing surface 42 of the insert 32 has a pair of opposed alignment protrusions 58 (see FIGS. 18, 18A and 19) which assist with maintaining the post 34 generally centered with respect to inwardly facing surface 42 of the insert 32 so as to achieve the desired flow therebetween. It is to be appreciated, however, that an inwardly facing surface 59 of each one of the two opposed alignment protrusions 58 is designed to be spaced away from the outwardly facing surface 40 of the post 34 by a distance of between 0.002 and 0.005 of an inch, as shown in FIG. 18. As a result of such arrangement, the two opposed alignment protrusions 58 generally assist with spacing a remainder of the inwardly facing cylindrical surface 42 of the insert 32 sufficiently away from the exterior surface of the post 34 so as to define a partially restricted flow passage 61, between each inwardly facing surface 59 of the alignment protrusion 58 and the outwardly facing surface 40 of the post 34. As with the previous embodiments, the leading open side of the post passage 30 is sealed or closed when the insert 32 is assembled within the actuator 22.

As a result of the first and the second alignment protrusions 58 facilitate spacing the inwardly facing surface 42 of the insert 32 away from the post 34 so that a pair of first and second separate and distinct product flow passages/paths 52, 54 are defined on either side of the first and the second diametrically alignment protrusions 58, between the inwardly facing surface 42 of the insert 32 and the outwardly facing surface of the post 34.

According to this embodiment, the post 34 does not sealingly engage with any portion of the inwardly facing surface 42 of the insert 32 nor does the inwardly facing surface 42 of the insert 32 sealingly engage with the post 34. This embodiment only provides a partial obstruction, i.e., partially restricted flow passages 61 formed between each inwardly facing surface 59 of the respective alignment protrusion 58 and the outwardly facing surface 40 of the post 34 which still permits a limited amount of the product to flow therebetween. As a result, most of the product to be dispensed through the insert 32 is channeled along either one of the first or the second product flow passages/paths 52, 54 while only a minor portion of the product to be dispensed flows between the inwardly facing surfaces 61 of the alignment protrusions 58 and the outwardly facing surface 40 of the post 34.

It is to be appreciated that the first and the second separate and distinct product flow passages/paths 52, 54 are completed and defined when the insert 32 is coupled to or engaged with the actuator 22 and the inwardly facing surface 61 of each one of the two opposed alignment protrusions 58 is located and spaced from the outwardly facing surface 40 of the post 34 by a distance of between 0.002 and 0.005 of an inch. As a result, the product to be dispensed from the container primarily flows substantially along either the first or the second product flow passages/paths 52, 54 while only a small percentage of the product to be dispensed from the containerflows between the inwardly facing surfaces 61 of the alignment protrusions 58 and the outwardly facing surface 40 of the post 34.

Figure 16:
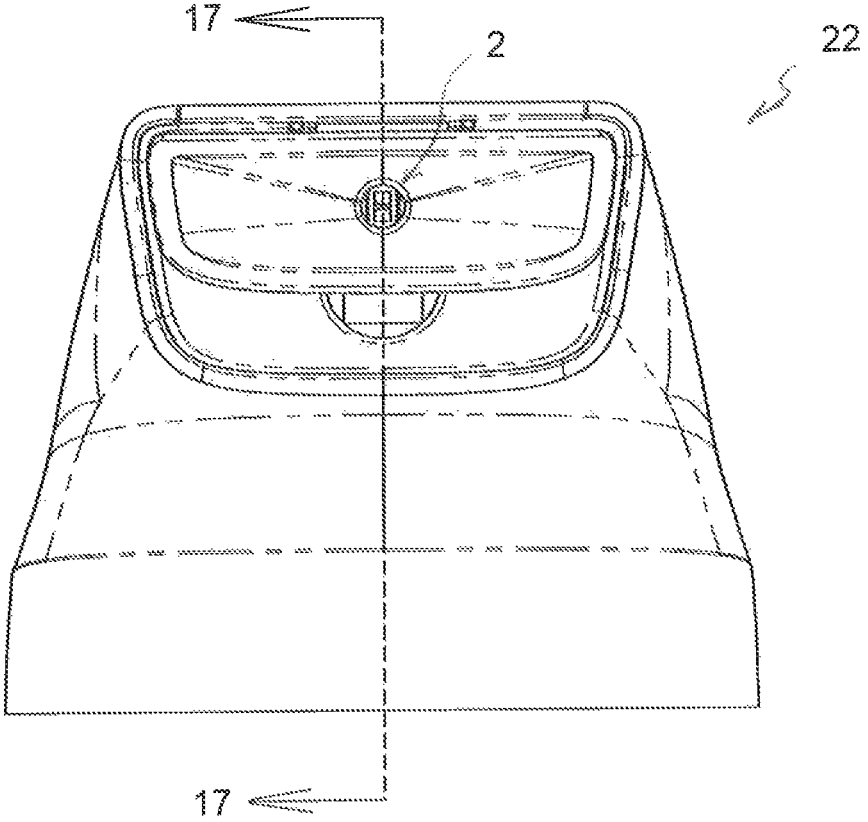
FIG. 16 is a diagrammatic front elevational view of the embodiment of FIG. 15.

As noted above, the nozzle 2 is formed in base 36 of the insert 32 and designed to dispense the product to be dispensed at a larger discharge angle, thereby to generate a spray having a non-conical shape. An inwardly facing surface 60 of the base of the insert 32 is spaced from an outwardly facing end surface 62 of the post 34 so as to define a flow redirecting dispensing chamber 64 therebetween. As shown in FIG. 16, an opening of the nozzle 2, formed in the base 36 of the insert 32, is generally rectangular in shape. As with the previous embodiments and generally shown in FIG. 20, first and second diametrically opposed stepped insert shoulders 66, 68 are formed within the base 36 of the insert and arranged to receive the product to be dispensed and redirect such product to be dispensed toward the nozzle 2.

A first conical surface 70 is integrally formed and joined with a first end of each of the first and second diametrically opposed stepped insert shoulders 66, 68 while an opposed second conical surface 72 is integrally formed and joined with an opposite second end of each of the first and second diametrically opposed stepped insert shoulders 66, 68. The first and second diametrically opposed stepped insert shoulders 66, 68 and the first and second diametrically opposed conical surfaces 70, 72 are designed to channel the product to be dispensed toward and out through the nozzle 2 achieve a desired substantially rectangular fan spray pattern. In order to facilitate the desired spray pattern, the first conical surface 70 is directly axially aligned with the first unobstructed product flow passage/path 52, while the second diametrically opposed second conical surface 72 is directly axially aligned with the second unobstructed product flow passage/path 54, while the first stepped insert shoulder 66 is directly axially aligned with the first alignment protrusion 58, which partially restricts/minimizes the flow of the product to be dispensed toward the first stepped insert shoulder 66, while the second diametrically opposed stepped insert shoulder 68 is directly axially aligned with the diametrically opposed second alignment protrusion 58, which partially restricts/minimizes the flow of the product to be dispensed toward the stepped insert shoulder 68. As a result of such arrangement, the product to be dispensed, which flows along either the first or the second product flow passages/paths 52, 54, is respectively channeled and generally directed toward the respective one of the first and the second diametrically opposed conical surfaces 70, 72 while a restricted portion of the product to be dispensed is directed toward and flows over either the first and the second diametrically opposed stepped insert shoulders 66, 68.

As the product to be dispensed flows over the first and second diametrically opposed stepped insert shoulders 66, 68 toward the nozzle 2, turbulence is induced and created by the micro steps into the product to be dispensed. Such turbulence is believed to assist with improving the formation and shape of the spray pattern of the product to be dispensed, once the same is discharged from the nozzle 2. The product to be dispensed, which is directed toward and flows along either the first and/or the second diametrically opposed conical surfaces 70, 72, generally assist with controlling width of the spray pattern of the product being dispensed, as the product to be dispensed is discharged from the nozzle 2.

As with the previous embodiments, each of the first and the second diametrically opposed stepped insert shoulders 66, 68 typically has a total of seven micro steps and each one of the micro steps becomes progressively becomes smaller, e.g., shorter in both length and height, in the direction of the nozzle 2. The micro steps are generally formed by a series of curved surfaces interconnecting a series of generally flat surfaces with one another which eventually transitions into a relative smooth surface at the nozzle 2. It is to be appreciated that the number, size and spacing of the micro steps can vary, from application to application, without departing from the spirit and scope of the present invention.

During dispensing of the product to be dispensed, the first and second diametrically opposed stepped insert shoulders 66, 68 and the diametrically opposed first and second conical surfaces 70, 72 combine with one another, as the product to be dispensed flows over those insert shoulders and conical surfaces, to generate a spray jet having a generally well-defined substantially rectangular discharge spray pattern. That is, the nozzle 2 has an elongate, rectangular shape which has a width that is greater than its length, i.e., the insert 32 produces a spray pattern that is generally rectangular in shape and has a dimension in a first length direction which is greater than its dimension in an opposite, second width direction.

During dispensing, the actuator 22 is activated to open the dispensing valve thereby releasing the product to be dispensed from the pressurized container, through the actuator 22 and into the external environment. During discharge, the product to be dispensed travels through the passage 28 and into the actuator outlet 30. The product to be dispensed then flows along either the first or the second product flow passages/paths 52, 54, along the exterior surface of the post 34 and the inwardly facing surface 42 of the insert 32. The product to be dispensed continues flowing along either the first or the second product flow passages/paths 52 or 54 and eventually flows into the flow redirecting dispensing chamber 64. Upon entering the flow redirecting dispensing chamber 64, the product to be dispensed is then redistributed but primarily flows over either the first or the second diametrically opposed stepped insert shoulders 66, 68, while only a minor amount/quantity of product flows over either the first or the second diametrically opposed conical surfaces 70 or 72. Such redistribution of the product to be dispensed causes the product to be dispensed to be discharged through the nozzle 2 in a desired spray discharge pattern, e.g., a generally rectangular shape.

While various embodiments of the present invention have been described in detail, it is apparent that various modifications and alterations of those embodiments will occur to and be readily apparent to those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

We claim:

1. An actuator comprising:

an actuator outlet being formed within the actuator;

a post being centrally located within the actuator outlet of the actuator and extending normal to a base surface of the actuator outlet toward an open end of the actuator outlet;

an insert being mounted and securely retained within the actuator outlet by an interference fit, and a base of the insert having a rectangular-shaped discharge nozzle formed therein;

first and second alignment protrusions being sized and shaped so as to assist with spacing an inwardly facing cylindrical surface of the insert away from an exterior surface of the post and respectively define a first and second partially restricted flow passages between the inwardly facing cylindrical surface and the exterior surface of the post, with first and second unobstructed product flow passages being defined one either side of the first and the second alignment protrusions; and the nozzle being defined within the base of the insert by diametrically opposed first and second stepped shoulders and diametrically opposed first and second conical surfaces, the first stepped shoulder being axially aligned with the first partially restricted flow passage and the first conical surface being axially aligned with the first unobstructed flow passage while the second stepped shoulder being axially aligned with the second partially restricted flow passage and the second conical surface being axially aligned with the second unobstructed flow passage so that the product to be dispensed, upon flowing through the actuator and being discharged from the nozzle, is sprayed by the nozzle in a desired fan spray pattern.

2. The actuator according to claim 1, wherein each of the first and the second stepped shoulders comprises a plurality of micro steps which comprise a series of curved surfaces interconnecting a series of generally flat surfaces with one another which eventually transition into a relative smooth surface at an outlet of the nozzle.

3. The actuator according to claim 2, wherein each of the first and the second stepped shoulders comprises seven separate micro steps.

4. The actuator according to claim 2, wherein a largest micro step, of the plurality of micro steps, has a length of about 0.012 inches and the largest micro step is spaced from an adjacent second largest micro step by a distance of about 0.005 inches, and each remaining micro step has a shorter length and is spaced closer to adjacent micro steps by a smaller distance than the spacing of the largest micro step to a second largest micro step.

5. The actuator according to claim 1, wherein as the product to be dispensed flows over the first and second diametrically opposed stepped shoulders toward outlet of the nozzle, turbulence is induced and created by the micro steps into the product to be dispensed to assist with formation and shaping of the spray pattern of the product to be dispensed, once the product to be dispensed is discharged from the nozzle.

6. The actuator according to claim 1, wherein an inwardly facing surface of each one of the first and the second alignment protrusions is spaced away from an outwardly facing surface of the post by a distance of between 0.002 and 0.005 of an inch.

7. The actuator according to claim 1, wherein the insert is manufactured from a resilient plastic.

8. The actuator according to claim 1, wherein the insert is manufactured from one of acetal, polypropylene and polyethylene.

9. The actuator according to claim 1, wherein each of the first and the second conical surfaces have a radius of curvature of between 0.050 inches and 0.100 inches.

10. The actuator according to claim 1, wherein each of the first and the second conical surfaces have a radius of curvature of 0.075 inches.

11. The actuator according to claim 1, wherein an outwardly facing cylindrical surface of the insert is sized and shaped to frictionally engage with an inwardly facing surface of the actuator outlet while an inwardly facing surface of the insert surround but is spaced from an exterior surface of the post of the actuator.

12. The actuator according to claim 1, wherein an opening of the nozzle has a length of about 0.055 inches and a width of about 0.015 inches.

13. The actuator according to claim 1, wherein an inwardly facing surface of the base of the insert is spaced from an outwardly facing end surface of the post so as to define a flow redirecting dispensing chamber therebetween, and an opening of the nozzle, formed in the base of the insert, is generally rectangular in shape. a length of about 0.055 inches and a width of about 0.015 inches.

14. An actuator comprising:

an actuator outlet being formed within the actuator;

a post being centrally located within the actuator outlet of the actuator and extending normal to a base surface of the actuator outlet toward an open end of the actuator outlet, and the post comprising diametrically opposed first and second post shoulders;

an insert being mounted and securely retained within the actuator outlet by an interference fit, and a base of the insert forming a rectangular-shaped discharge nozzle;

the first and second post shoulders being sized and shaped to engage with an inwardly facing surface of the insert and space a remaining portion of the inwardly facing surface of the insert away from partially recessed outwardly facing surfaces of the post so as to define first and second separate and distinct product flow passages substantially within the post; and the nozzle being defined within the base of the insert by diametrically opposed first and second stepped shoulders and diametrically opposed first and second conical surfaces formed, and the first and the second stepped insert shoulders being arranged to receive, from a respective one of the first and second product flow passages, and redirect a major portion of the product to be dispensed toward the nozzle, while a pair of diametrically opposed first and second conical surfaces, formed within the base of the insert, being arranged to receive, from a respective one of the first and second product flow passages, and redirect only a minor portion of the product to be dispensed toward the nozzle.

15. The actuator according to claim 14, wherein one of a leading and a trailing end of the inwardly facing surface of the insert supports at least one alignment member which assist with properly aligning the insert with the post during assembly of the insert with the actuator.

16. The actuator according to claim 14, wherein each of the first and the second stepped shoulders comprises a plurality of micro steps which comprise a series of curved surfaces interconnecting a series of generally fiat surfaces with one another which eventually transition into a relative smooth surface at an outlet of the nozzle.

17. The actuator according to claim 16, wherein each of the first and the second stepped shoulders comprises seven separate micro steps.

18. The actuator according to claim 16, wherein a largest micro step, of the plurality of micro steps, has a length of about 0.012 inches and the largest micro step is spaced from an adjacent second largest micro step by a distance of about 0.005 inches, and each remaining micro step has a shorter length and is spaced closer to adjacent micro steps by a smaller distance than the spacing of the largest micro step to a second largest micro step.

19. The actuator according to claim 11, wherein as the product to be dispensed flows over the first and second diametrically opposed stepped shoulders toward outlet of the nozzle, turbulence is induced and created by the micro steps into the product to be dispensed to assist with formation and shaping of the spray pattern of the product to be dispensed, once the product to be dispensed is discharged from the nozzle.

20. A method of discharging a product to be dispensed from an actuator in a fan spray pattern, the method comprising:

forming an actuator outlet within the actuator;

centrally locating a post within the actuator outlet of the actuator and so as to extend normal to a base surface of the actuator outlet toward an open end of the actuator outlet;

mounting and securely retaining an insert within the actuator outlet by an interference fit, and a base of the insert having a rectangular-shaped discharge nozzle formed therein;

sizing and shaping first and second alignment protrusions so as to assist with spacing an inwardly facing cylindrical surface of the insert away from an exterior surface of the post and respectively define a first and second partially restricted flow passages between the inwardly facing cylindrical surface and the exterior surface of the post, with first and second unobstructed product flow passages being defined one either side of the first and the second alignment protrusions; and defining the nozzle within the base of the insert by diametrically opposed first and second stepped insert shoulders and diametrically opposed first and second conical surfaces, the first stepped shoulder being axially aligned with the first partially restricted flow passage and the first conical surface being axially aligned with the first unobstructed flow passage while the second stepped shoulder being axially aligned with the second partially restricted flow passage and the second conical surface being axially aligned with the second unobstructed flow passage so that the product to be dispensed, upon flowing through the actuator and being discharged from the nozzle, is sprayed by the nozzle in a desired fan spray pattern.

* * * * *